US006349524B1

(12) United States Patent
Zurlinden et al.

(10) Patent No.: US 6,349,524 B1
(45) Date of Patent: Feb. 26, 2002

(54) BOTTLE SEALING METHOD AND APPARATUS

(75) Inventors: David Paul Zurlinden; David Marc Zurlinden, both of Carmel Valley; Malcolm Yuill-Thornton, Cotati, all of CA (US)

(73) Assignee: Patented Innovations, LLC, Cotati, CA (US)

( * ) Notice: Subject to any disclaimer, the term of this patent is extended or adjusted under 35 U.S.C. 154(b) by 0 days.

(21) Appl. No.: 09/480,917

(22) Filed: Jan. 11, 2000

Related U.S. Application Data

(63) Continuation-in-part of application No. 09/384,904, filed on Aug. 27, 1999, now Pat. No. 6,205,744.

(51) Int. Cl.[7] ..... B65B 61/00

(52) U.S. Cl. ..... 53/423; 53/420; 53/489; 53/264

(58) Field of Search ..... 53/423, 420, 489, 53/264, 319, 487; 215/364, 355; 425/809; 264/255, 254, 267, 28

(56) References Cited

U.S. PATENT DOCUMENTS

| | | | | |
|---|---|---|---|---|
| 2,013,304 A | | 9/1935 | Glunz | 53/319 |
| 2,811,002 A | | 10/1957 | Dimond | 53/342 |
| 3,067,552 A | * | 12/1962 | Aubry | 53/420 |
| 3,133,389 A | * | 5/1964 | Randrup et al. | 53/420 |
| 3,712,017 A | | 1/1973 | Knabe et al. | 53/319 |
| 3,771,283 A | | 11/1973 | Over et al. | 53/343 |
| 3,832,892 A | | 9/1974 | Bohl | 53/341 |
| 3,841,056 A | | 10/1974 | Vandrebeck | 53/341 |
| 3,936,991 A | * | 2/1976 | Deix | 53/319 |
| 3,946,540 A | | 3/1976 | Solberg et al. | 53/341 |
| 3,961,463 A | | 6/1976 | Dimond et al. | 53/319 |
| 4,771,588 A | | 9/1988 | Lofgren et al. | 53/319 |
| 4,803,031 A | * | 2/1989 | Ochs et al. | 264/255 |
| 4,979,282 A | * | 12/1990 | Alieri et al. | 425/809 |
| 4,984,415 A | * | 1/1991 | Kuroda | 53/489 |
| 5,261,547 A | | 11/1993 | Finke | 215/233 |

(List continued on next page.)

*Primary Examiner*—Peter Vo
*Assistant Examiner*—Sam Tawfik
(74) *Attorney, Agent, or Firm*—Townsend and Townsend and Crew LLP

(57) ABSTRACT

An embossed seal is formed in a cavity in the neck of a corked bottle over a cork using a die having a die surface with a die image. A first molten seal material is introduced into a die cavity. The die cavity is formed in part with the die surface. The introduction of the first molten seal material deposits an embossed seal portion with an embossed surface. The embossed seal portion is allowed to cool. A second molten seal material is introduced into the cavity of the neck of the corked bottle. The embossed seal portion is brought into contact with the molten seal material in the bottle cavity with the embossed surface disposed on top facing away from the molten seal material. The molten seal material partially melts the embossed seal portion to form a single seal upon cooling. The embossed seal portion is sufficiently cooled and solidified to prevent melting and damage of the embossed surface. An automated apparatus is provided for carrying out the two-stage procedure of forming the seal to produce high quality embossed seals at an economically desirable rate. A die truck assembly is used to form the embossed seal portion. The assembly includes three springs to provide a triple telescoping action that allows the assembly to be engaged with the bottle necks and maintains the engagement along a specific travel path to form the seal to seal the bottle. The triple telescoping action also releases the embossed seal portion from the die cavity of the die truck assembly into the molten seal material in the cavity over the cork in the bottle neck. It further allows the die truck assembly easily to self-adjust and compensate for varying bottle heights and varying cork heights so as to exert a generally consistent pressure on the embossed seal portion and molten seal material to form the finished seal.

21 Claims, 13 Drawing Sheets

U.S. PATENT DOCUMENTS

| | | | | |
|---|---|---|---|---|
| 5,447,246 | A | | 9/1995 | Finke ..... 215/233 |
| 5,449,080 | A | | 9/1995 | Finke ..... 215/233 |
| 5,553,728 | A | | 9/1996 | Finke ..... 215/233 |
| 5,654,022 | A | | 8/1997 | Sayre ..... 426/118 |
| 5,904,886 | A | * | 5/1999 | Stecker ..... 264/255 |
| 6,007,315 | A | * | 12/1999 | Busacchi ..... 425/809 |

* cited by examiner

BOTTLE SEALING METHOD AND APPARATUS

This application is a continuation-in-part of and claims Ser. No. 09/384,904, filed Aug. 27, 1999, U.S. Pat. No. 6,205,744 the entire disclosure of which is incorporated herein by reference in its entirety.

BACKGROUND OF THE INVENTION

This invention relates generally to sealing corked bottles and, more particularly, to automated methods and apparatus for forming embossed seals on corked bottles having high-quality embossed images at a commercially desirable process rate.

One of the methods of sealing corked bottles involves the use of thermoplastic seals. A thermoplastic material is typically injected in liquefied form into the mouth of the neck of a corked bottle and placed on top of the cork wherein it hardens and forms a seal with the interior surface of the bottle neck and the cork. Thermoplastic seals are generally preferred over lead-containing metal foils and more aesthetically pleasing than plastic seals. Thermoplastic seals that include an aesthetic finish of an embossed design or logo on the exposed top surface are often desirable. Embossed thermoplastic seals can also be tamper-evident.

Finishing or embossing a thermoplastic seal on a corked bottle presents production problems. The time it takes for the liquefied thermoplastic material to harden can severely impact production speed. If the liquefied thermoplastic material is not allowed to harden sufficiently, the residual heat may melt part or all of the hardened finish and ruin the embossing. In addition, the embossing step requires precise control to ensure that the embossing is uniform for each seal. Uniformity must be achieved without sacrificing production speed.

SUMMARY OF THE INVENTION

The present invention is directed to an apparatus and method for forming embossed seals on corked bottles at a process rate that is economically desirable while achieving uniformity and avoiding residual heat problems. This is accomplished by forming the seal in two stages. First, an upper seal portion is formed by introducing molten seal material into a die cavity formed using a die having a die surface with a die image of a logo or design. The upper seal portion is allowed to cool sufficiently so that the region around the embossed image is solidified. Molten seal material is separately introduced into the cavity above the cork in the bottle neck. In the second stage, the cooled upper seal portion is brought into contact with the molten seal material in the bottle neck cavity with the embossed image disposed on top facing away from the molten seal material. The bottom region of the upper seal portion is partially melted and joined with the molten seal material to form a single seal over the corked bottle upon cooling. The upper seal portion is adequately cooled and solidified so that the embossed image is not melted or otherwise damaged during the partial melting by and joining with the molten seal material at the bottom. In a preferred embodiment, this process is automated and is sufficiently fast and repeatable to produce high quality embossed seals for sealing corked bottles.

An aspect of the present invention is directed to a method of forming an embossed seal in a cavity in the neck of a corked bottle over a cork using a die having a die surface with a die image. The method includes bringing the die surface in contact with a first molten seal material and cooling the molten seal material to form an embossed seal portion with an embossed surface on one side and an interface surface on another side. A second molten seal material is introduced into the cavity of the neck of the corked bottle over the cork. The interface surface of the cooled embossed seal portion is brought into contact with the molten seal material in the cavity to partially melt the embossed seal portion and join the embossed seal portion with the molten seal material in the cavity to form a seal having the embossed surface over the cork. The amount of the first molten seal material typically includes about 50% to about 90% of the sum of the amount of the first molten seal material and the amount of the second molten seal material. In a specific embodiment, the amount of the first molten seal material is about 80% of the sum of the first and second molten seal material. In a preferred embodiment, the contact between the die surface and the embossed seal portion is maintained until the molten seal material in the cavity is at least partially solidified.

In some embodiments, a gas flow is directed toward the first molten material to distribute the first molten material to form a desired interface surface profile. For example, the interface surface profile formed may be generally planar, or generally concave with a raised edge around a depressed center. A gas flow may be directed toward the second molten material to distribute the second molten material to form a desired surface profile, which may be, for instance, generally planar or generally concave.

In accordance with another aspect of the invention, a die truck assembly for forming the first seal portion includes an actuator guide block and a die holder coupled with the actuator guide block by an actuator spring. The die holder is movable relative to the actuator guide block between a rest position and a compressed position. The actuator spring is compressed in the compressed position to bias the die holder toward the rest position. The die holder includes a die stem having a die support portion and a spring seat. A centering member is coupled with the spring seat by an engagement spring and is movable relative to the spring seat between a rest position and a compressed position. The engagement spring is compressed in the compressed position to bias the centering member toward the rest position.

In preferred embodiments, the die holder further includes a blocking member which is generally fixed on the die stem. The blocking member is coupled with the spring seat by a die stem spring and is movable relative to the spring seat between a rest position and a compressed position. The die stem spring is compressed in the compressed position to bias the blocking member toward the rest position. In a specific embodiment, the die holder includes an actuator guide tube and the actuator spring is coupled between the actuator guide tube and the actuator guide block. The spring seat is generally fixed on the actuator guide tube, and the die stem is slidable relative to the actuator guide tube. A die is supported by the die support portion, and includes a die surface with a die image. The centering member includes an inner wall which is disposed around the die. The die is recessed from the edge of the inner wall in the rest position of the engagement spring to form a die cavity with the inner wall. When the engagement spring is compressed in the compressed position, the die protrudes from the edge of the inner wall to release the first seal portion from the assembly.

The actuator spring, engagement spring, and die stem spring provide a triple telescoping action of the die truck assembly that (1) allows it to be engaged with the bottle neck and maintains the engagement along a specific travel path to form a seal to seal the bottle; (2) releases the embossed seal portion from the die cavity of the die truck assembly into the molten seal material in the cavity over the cork in the bottle neck; and (3) allows the die truck assembly easily to self-adjust and compensate for varying bottle heights and varying cork heights so as to exert a generally consistent pressure on the embossed seal portion and molten seal material to form the finished seal.

In accordance with another aspect of the invention, a die truck assembly comprises a die holder including a die stem having a die support portion and a spring seat. The die holder includes a blocking member which is generally fixed on the die stem. The blocking member is coupled with the spring seat by a die stem spring and is movable relative to the spring seat between a rest position and a compressed position. The die stem spring is compressed in the compressed position to bias the blocking member toward the rest position. A centering member is coupled with the spring seat by an engagement spring and is movable relative to the spring seat between a rest position and a compressed position. The engagement spring is compressed in the compressed position to bias the centering member toward the rest position.

The engagement spring and die stem spring provide a double telescoping action of the die truck assembly that releases the embossed seal portion from the die cavity of the die truck assembly into the molten seal material in the cavity over the cork in the bottle neck, and allows the die truck assembly easily to self-adjust and compensate for varying bottle heights and varying cork heights so as to exert a generally consistent pressure on the embossed seal portion and molten seal material to form the finished seal. In this embodiment, the bottle is typically moved toward the die truck assembly to engage the bottle neck with the assembly.

In accordance with another aspect of the present invention, an apparatus for forming embossed seals in cavities in the necks of corked bottles includes a main support frame and an endless drive chain mounted on the main support frame. A plurality of die truck assemblies are spaced along and coupled with the endless drive chain. Each die truck assembly includes a die cavity. A first applicator is provided for introducing a first molten seal material into the die cavity of each die truck assembly to form a first seal portion therein. A second applicator is provided for introducing a second molten seal material into the cavity of the neck of each corked bottle. The apparatus further includes a bottle conveyor for conveying the bottles to generally align the neck of each bottle with one of the plurality of die truck assemblies over a portion of travel of the conveyor. A release mechanism is provided for releasing the first seal portion from each die truck assembly into the second molten seal material in the cavity of the neck of one of the corked bottles.

In some embodiments, at least one nozzle is provided for directing a gas flow toward the first molten seal material in the die cavity to distribute the first molten seal material and form the first seal portion therein with a desired interface surface profile. The nozzle may be coupled to a cooling gas source to direct a cooling gas flow toward the first molten seal material to cool the first molten seal material. The nozzle may be configured to direct the gas flow toward the central region of the first molten seal material to spread the first molten seal material from the central region to the edge region thereof.

In some embodiments, at least one nozzle is provided for directing a gas flow toward the second molten seal material in the cavity of the neck of each corked bottle to distribute the second molten seal material and form the second seal portion therein with a desired surface profile. The nozzle may be coupled to a cooling gas source to direct a cooling gas flow toward the second molten seal material to cool the second molten seal material.

In preferred embodiments, a first reciprocator is coupled with the first applicator for cyclically moving the first applicator to follow the movement of each die truck assembly between a first position and a second position to provide additional deposition time for the first molten seal material. A second reciprocator is coupled with the second applicator for cyclically moving the second applicator to follow the movement of each bottle between a first position and a second position to provide additional deposition time for the second molten seal material. A bottle guide in the form of a timing screw is provided for guiding the bottles onto the bottle conveyor at a speed and a spacing between adjacent bottles to generally align the neck of each bottle with one of the die truck assemblies driven by the drive chain.

In a specific embodiment, a single variable-speed drive motor is provided for driving a drive sprocket coupled with the drive chain, the first reciprocator, the second reciprocator, and the timing screw. The connections between the drive motor and these components preferably synchronize the movements of the components for introducing the first molten seal material into the die cavity of each die truck assembly, introducing the second molten seal material into the cavity in each bottle neck, and aligning each die truck assembly with the corresponding bottle to form the finished seal by joining the upper and lower seal portions inside the cavity of the bottle. The synchronism in the specific embodiment is achieved by mechanical connections. By adjusting the speed of the drive motor, the process rate of the apparatus can be easily changed while preserving the synchronized movement of the various components.

In a preferred embodiment, the drive motor, drive sprocket and drive chain, first reciprocator, and second reciprocator are attached to the main support frame, while the timing screw is attached to a lower support frame. The main support frame is adjustable in position relative to the lower support frame when necessary to adapt the apparatus for processing bottles of a different height. The attachment of these components to the upper and lower support frames, respectively, and easy adjustment of the upper support frame relative to the lower support frame simplifies the process of adapting the apparatus to different bottle heights.

BRIEF DESCRIPTION OF THE DRAWINGS

The preferred embodiments of this invention, illustrating all their features, will now be discussed in detail. These embodiments depict the novel and nonobvious bottle sealing method and apparatus of this invention shown in the accompanying drawings, which are included for illustrative purposes only. These drawings include the following figures, with like numerals indicating like parts.

DESCRIPTION OF THE SPECIFIC EMBODIMENTS

The bottle sealing method of the present invention is based on forming a first seal portion using a die having a die surface with a die image of a logo or design or the like, and combining the first seal portion with a second seal portion formed in a bottle cavity over the cork in the neck of a corked bottle. The first seal portion is formed by injecting a first amount of a molten seal material into the die cavity of the die and the second seal portion is formed by injecting a second amount of the molten seal material into the bottle cavity. The first seal portion has an embossed surface on one side and an interface surface on another side. After the first seal portion is cooled, the interface surface is brought into contact with the second seal portion in the bottle cavity while the seal material of the second seal portion is still in the molten state. The molten seal material partially melts the first seal portion near the interface surface and joins with the first seal portion to form a single finished seal over the cork in the neck of the bottle.

Figure 1A:
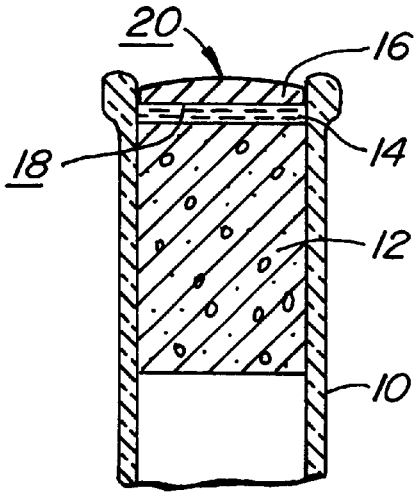
FIG. 1*a* is a cross-sectional view of a neck of a corked bottle showing a cork, a molten seal material disposed in the neck above the cork, and an upper seal portion disposed over the molten seal material.

FIG. 1*a* shows a bottle neck 10 with a cork 12 disposed therein. A molten seal material 14 is disposed in the neck 10 above the cork 12. A first or upper seal portion 16 is placed over the molten seal material 14 with an interface surface 18 in contact with the molten seal material 14 and an embossed surface 20 facing upward opposite from the interface surface 18 away from the molten seal material 14. The molten seal material 14 partially melts the upper seal portion 16 near the interface surface 18 to join with the upper seal portion 16 and form a single finished seal 22 shown in FIG. 1*b*. FIG. 2 shows the seal 22 with the embossed surface 20. Although the same seal material is typically used for both the first seal portion 16 and the second seal portion 14, different seal materials can be used.

The volume of the upper seal portion 16 typically ranges from about 50% to about 90% of the total volume of the seal 22. In a specific embodiment, the upper seal portion 16 is about 80% of the seal 22, in volume. The seal material is typically a thermoplastic material such as an organic polymer material, a synthetic thermoplastic material, or beeswax. The upper seal portion 16 desirably is at least substantially solidified before the interface surface 18 is brought into contact with the molten seal material 14 to ensure that only part of the upper seal portion 16 near the interface surface 18 is melted. The upper seal portion 16 has a sufficient volume to space the embossed surface 20 from the interface surface 18 sufficiently to prevent melting of the embossed surface 20 by the molten seal material 14.

Bottle Scaling Apparatus

Figure 1B:
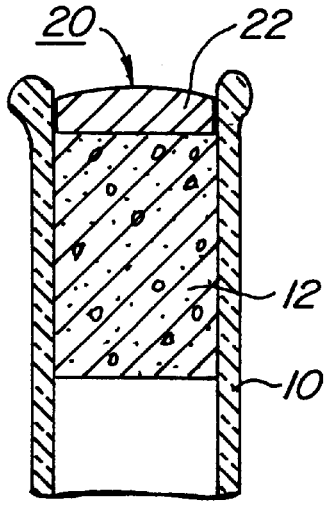
FIG. 1*b* is a cross-sectional view of the bottle of FIG. 1*a* showing a seal disposed in the neck above the cork after solidification of the molten seal material to form a lower seal portion joined with the upper seal portion.
Figure 2:
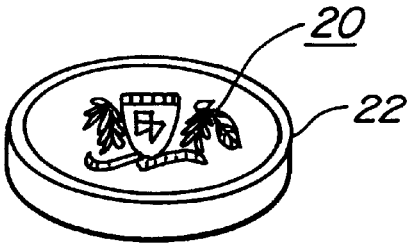
FIG. 2 is a perspective view of the seal of FIG. 1*b;*

FIGS. 3–6 show a bottle sealing apparatus 30 for sealing corked bottles by forming seals similar to the seal 22 of FIGS. 1*b* and 2 in an automated process. The apparatus 30 includes an upper main support frame 32 connected with and supported above a lower support frame 34. Mounted on the upper support frame 32 is an endless drive chain 36, which travels along a path that includes a generally horizontal upper path portion 38 and a generally horizontal lower path portion 40 that are generally straight. The chain path further includes a first curved path along a portion of a drive sprocket 42 and a second curved path along a portion of a guide sprocket 44. The two curved paths are connected between the upper path portion 38 and the lower path portion 40 to form an oval-shaped carousel. In the embodiment shown, the drive chain 36 is oriented generally along a vertical plane.

Figure 3:
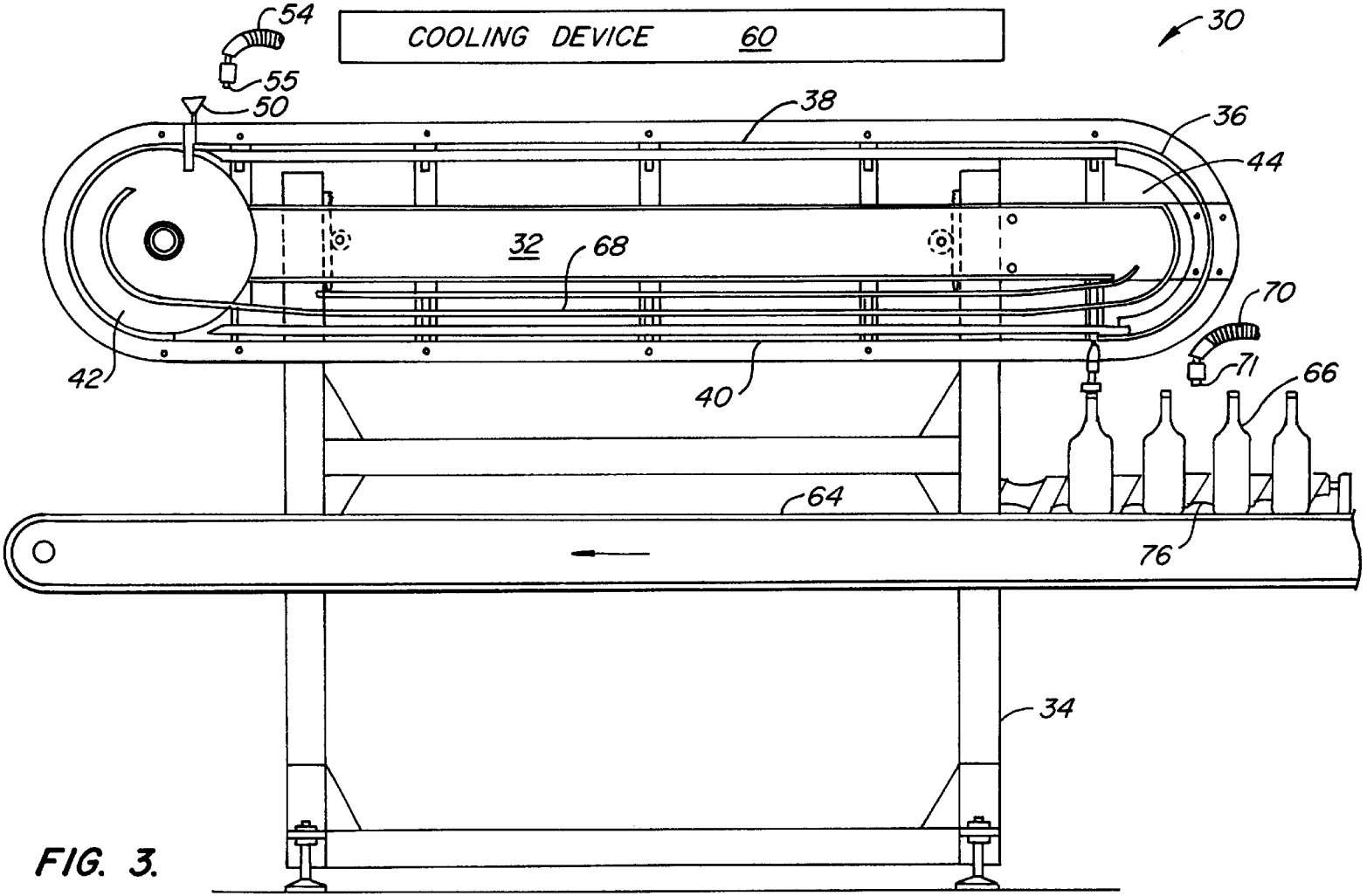
FIG. 3 is a front elevational view of a bottle sealing apparatus in accordance with an embodiment of the present invention.
Figure 5:
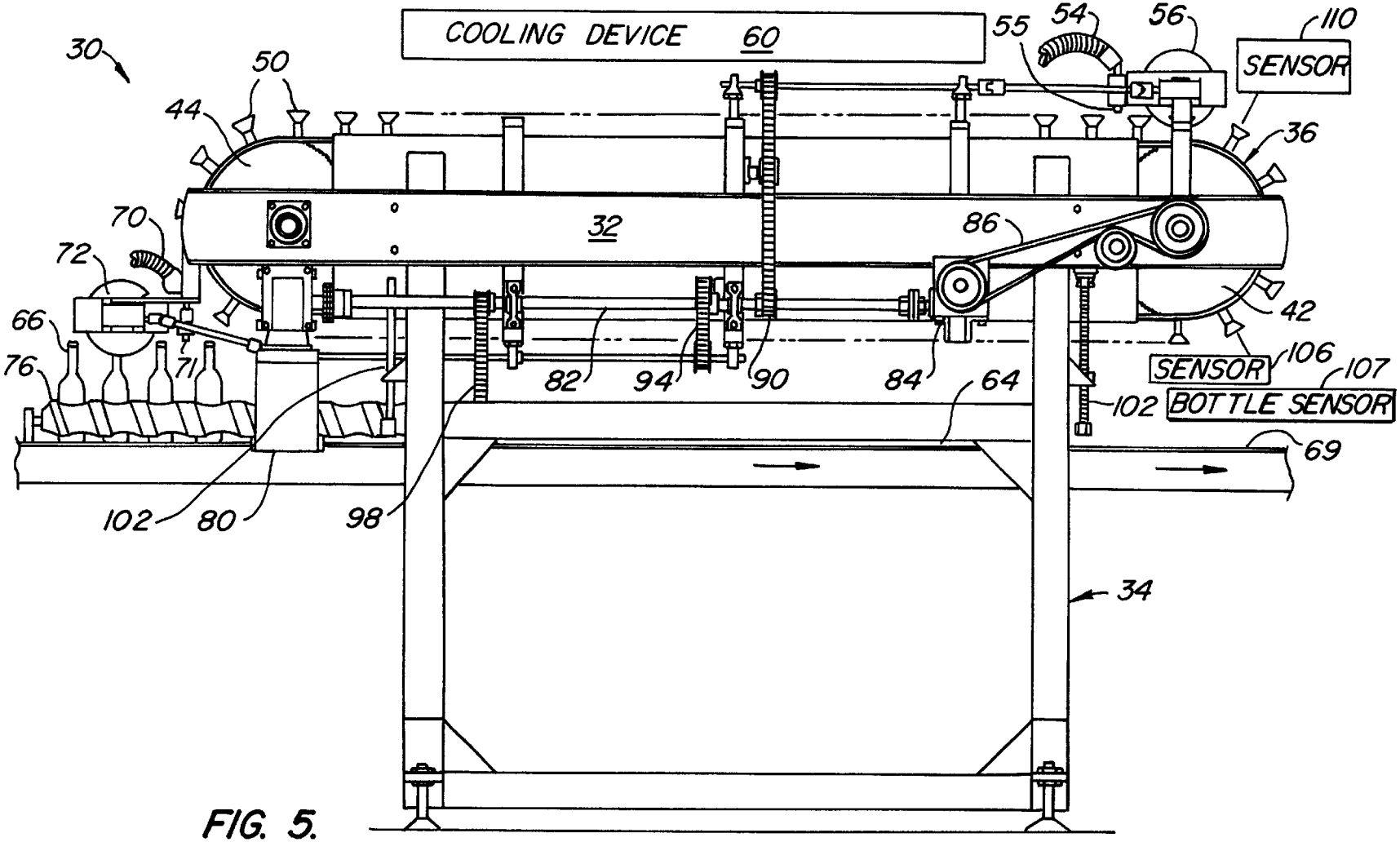
FIG. 5 is a rear elevational view of the bottle scaling apparatus of FIG. 3.

A plurality of die truck assemblies 50 (as best seen in FIG. 5) are spaced along and coupled with the endless drive chain 36, which is driven to move the die truck assemblies 50 continuously in a clockwise direction in the front elevational view of FIG. 3. Each die truck assembly 50 includes a die cavity for forming the upper embossed seal portion 16 shown in FIG. 1*a*. The details of the die truck assembly 50 are discussed below (see FIGS. 8–14). The die truck assemblies 50 desirably are evenly spaced along the endless drive chain 36. The die truck assemblies 50 are disposed with the die cavities oriented upward along the upper path portion 38 of the drive chain 36, and are disposed with the die cavities oriented downward along the lower path portion 40.

As shown in FIGS. 3 and 5, a first applicator 54 is disposed near the start of the upper path portion 38 for introducing a first amount of molten seal material through a first nozzle 55 into the die cavity of each die truck assembly 50 to form an upper embossed seal portion 16 therein when the die cavity is oriented upward. A first reciprocator 56 is desirably provided for cyclically moving the first applicator 54 to follow the movement of each die truck assembly 50 for a first deposition dwell time and to introduce the molten seal material into the die cavity of the assembly 50 during the first deposition time period. This significantly increases the deposition time of the molten seal material and improves the deposition quality. The first reciprocator 56 begins at a first position and moves the first applicator 54 to a second position to maintain the nozzle 55 of the first applicator 54 in general alignment with the die cavity of the assembly 50. Upon reaching the second position, the first reciprocator 56 separates the first applicator 54 from the assembly 50 and returns it to the first position to meet the next die truck assembly 50 and begin the next cycle of reciprocating movement. The reciprocating motion can be generated by, for example, a rotating cam. In one embodiment, the first deposition time period is about 40–50 milli-seconds for a travel distance of about 2 inches.

Figure 4:
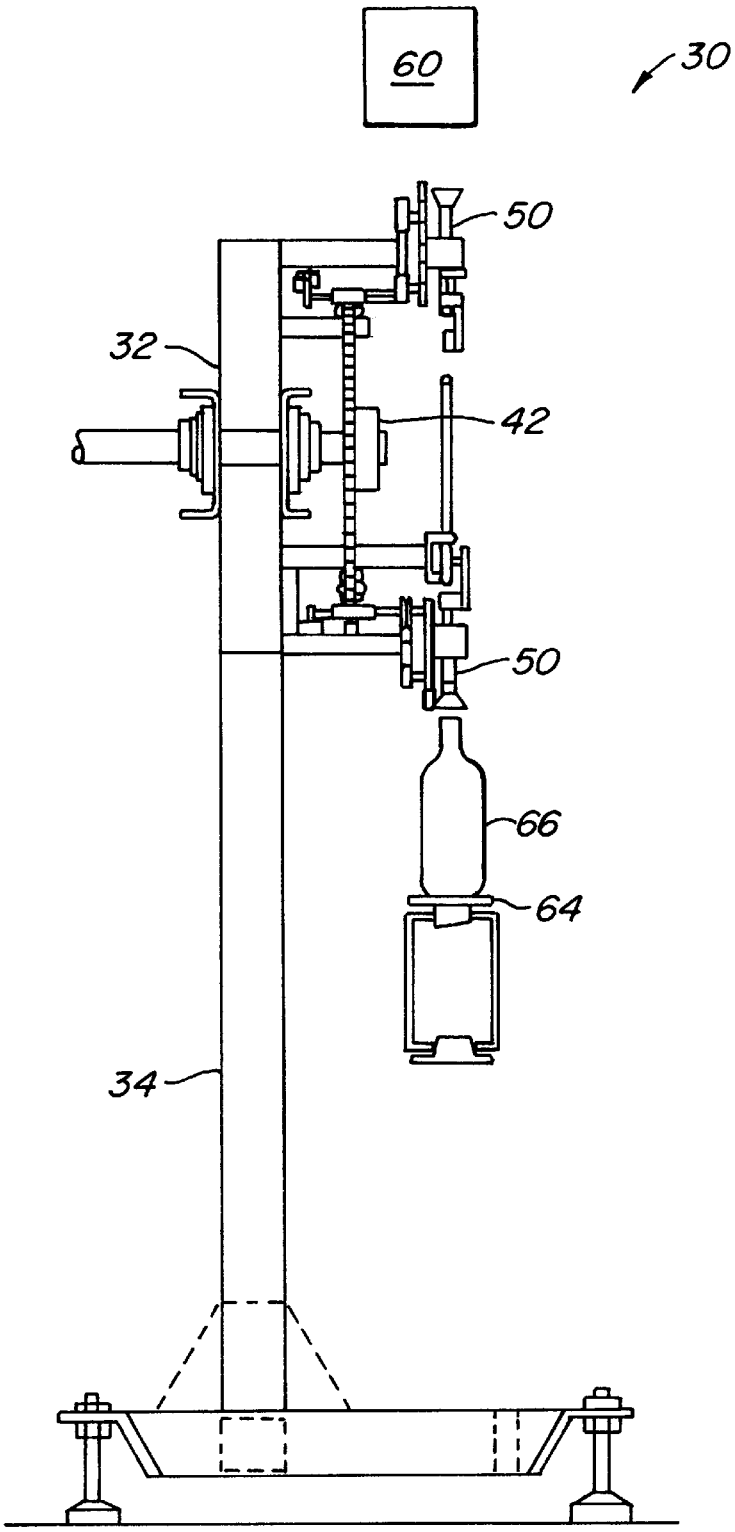
FIG. 4 is a side elevational view of the bottle sealing apparatus of FIG. 3.

As shown in FIGS. 3–5, a cooling device 60 is provided above the die truck assemblies 50 along the upper path portion 38 downstream of the first applicator 54 for cooling the molten seal material in the die cavities of the assemblies 50. The cooling device 60 in the embodiment shown includes a fan-driven air curtain blowing cool air toward the die truck assemblies 50. Liquid nitrogen may be introduced into the air curtain to assist the cooling of the molten seal material to form embossed seal portions 16 in the assemblies 50. After the die truck assemblies 50 pass through the cooling device 60, the drive chain 36 transports them to the lower path portion 40 where the embossed seal portions 16 in the die truck assemblies 50 are transferred to the bottle necks 10.

In addition to or instead of the cooling device 60, another embodiment of the invention employs a cooling mechanism that is more concentrated and focused than the cooling device 60. As shown in FIG. 3, a cooling nozzle 61 is provided downstream of the first applicator 54 for directing a cooling medium, such as air or air mixed with liquid nitrogen, into the die cavity of each die truck assembly 50 to cool the molten seal material. In FIG. 3, there are two cooling nozzles 61, but fewer or more nozzles may be used. The openings of the cooling nozzles 61 may have any suitable size, but are typically smaller, more typically substantially smaller, that the size of the die cavity. In a specific example, the die cavity has a diameter of about 0.7 inch, while the openings of the cooling nozzles 61 are about 3/16 inch in diameter. It is understood that the size and configuration of the cooling nozzles 61 may be altered.

The cooling nozzles 61 may produce a continuous flow of cooling medium or direct the cooling medium into the die cavity in pulses. For example, the cooling nozzles 61 may be activated with or triggered by the injection of molten material by the first applicator 54. To produce properly synchronized action in such an embodiment, the first cooling nozzle 61 is typically spaced from the nozzle 55 of the first applicator 54 by the distance between adjacent die trucks 50, and the second cooling nozzle 61 is spaced from the first nozzle by the same distance.

In addition to cooling the molten seal material in the cavity of the die truck 50, the cooling medium from the cooling nozzles 61 may also generate a more even distribution of the seal material. The injected molten seal material initially may tend to form a convex interface surface generally in the shape of an inverted bowl during solidification. The cooling nozzles 61 may be configured to direct the cooling medium generally in the center of the seal material so as to spread the seal material from the center to the edge. In some cases, it may be desirable to produce a sufficiently strong pulse or puff to produce a concave interface surface of the seal material generally in the shape of a bowl.

It is appreciated that the nozzles 61 may be used to direct a flow of air or the like to spread the molten seal material to obtain the desired surface profile without significant cooling. In that case, the cooling takes place under the cooling device 60.

When the cooling nozzles 61 are used together with the cooling device 60, the cooling nozzles 61 may be precisely controlled to induce skinning of the seal material without splashing the seal material. Formation of the skin prevents potential splashing of the seal material that may result from strong air flow under the cooling device 60.

A bottle conveyor 64 is provided below and disposed generally parallel to the lower path portion 40 for conveying bottles 66 in the same direction as the die truck assemblies 50 along the lower path portion 40. While the bottles 66 move along the conveyor 64, the speed of the drive chain 36 is synchronized with the speed of the conveyor 64 to generally align each die truck assembly 50 with the neck of one of the bottles. The upper support frame 32 includes a wheel track 68, as best seen in FIG. 3, which generally tracks the path of the drive chain 36 for guiding the assemblies 50. The wheel track 68 includes an offset portion along the lower path portion 40 of the drive chain 36. The offset portion is offset in the downward direction, thereby guiding the actuation portions of the die truck assemblies 50 downward to engage with the necks of the bottles 66 over at least a portion of travel of the endless drive chain 36 along the lower path portion 40. A customer conveyor 69 disposed adjacent the end of the bottle conveyor 64 takes the bottles 66 from the conveyor 64 and transports them to the next processing station (FIG. 5). In an alternative embodiment, a single conveyor replaces both the bottle conveyor 64 and the customer conveyor 69.

Prior to engaging the die truck assemblies 50 with the bottles 66, a second applicator 70 is provided near the start of the lower path portion 40 for introducing a second amount of the molten seal material through a second nozzle 71 into the cavity of the neck of each bottle 66, as seen in FIGS. 3 and 5. A second reciprocator 72 is desirably provided for cyclically moving the second applicator 70 to follow the movement of each bottle 66 for a second deposition dwell time and to introduce the molten seal material into the cavity of the bottle 66 during the second deposition time period. This significantly increases the deposition time of the molten seal material and improves the deposition quality The second reciprocator 72 begins at a first position and moves the second applicator 70 to a second position to maintain the nozzle 71 of the second applicator 70 in general alignment with the cavity of the bottle 66. Upon reaching the second position, the second reciprocator 72 separates the second applicator 70 from the bottle 66 and returns it to the first position to meet the next bottle 66 and begin the next cycle of reciprocating movement. The reciprocating motion can be generated by, for example, a rotating cam. In one embodiment, the second deposition time period is about 40–50 milli-seconds for a travel distance of about 2 inches.

Cooling nozzles 62 may also be placed downstream of the second applicator 70 for cooling the molten seal material in the cavity of the necks of the bottles 66, as shown in FIG. 3. The characteristics and operation of the cooling nozzles 62 are similar to those of the cooling nozzles 61 described above. The cooling nozzles 62 may be activated with or triggered by the injection of molten material by the second applicator 70. The first cooling nozzle 62 is typically spaced from the nozzle 71 of the second applicator 70 by the distance between adjacent bottles 66, and the second cooling nozzle 62 is spaced from the first nozzle by the same distance.

The cooling of the seal material in the bottle neck prior to joining with the embossed seal portion 16 from the die truck helps reduce the extent of the melting of the embossed seal portion 16 and preserve the embossed surface 20. The cooling is controlled so that the seal material is still sufficiently hot to partially melt the embossed seal portion 16 to form a single seal. Alternatively, the nozzles 62 may direct air or the like to spread the molten seal material to achieve the desired surface profile without significant cooling.

To ensure that the spacings between the bottles 66 on the conveyor 64 match the spacings between the die truck assemblies 50 on the drive chain 36 for proper alignment and engagement of the bottles 66 with the assemblies 50, a bottle guide 76 is provided near the start of the conveyor 64 to guide the bottles 66 onto the conveyor 64 with spacings that match the spacings between the assemblies 50. As best seen in FIGS. 3 and 5, the bottle guide in the embodiment shown is a timing screw 76 with a specific pitch. Rotating the timing screw 76 advances the bottles 66 and feeds them onto the conveyor 64. The speed of rotation of the timing screw 76 is synchronized with the speed of the drive chain 36 to generally align the necks of the bottles 66 as they travel on the conveyor 64 with the die truck assemblies 50.

Figure 6:
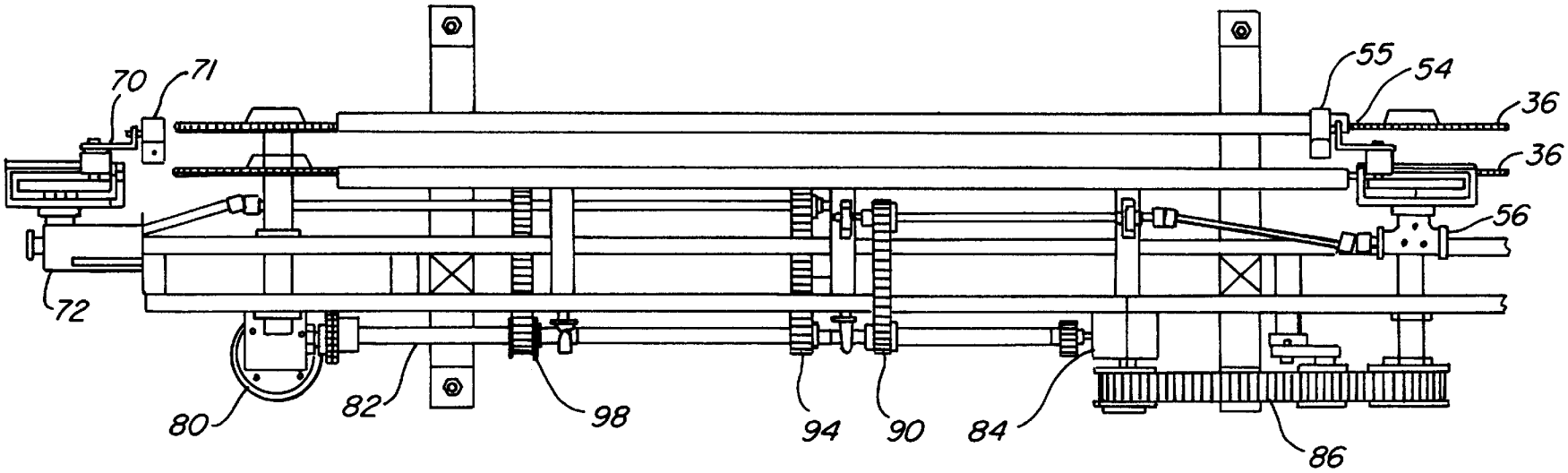
FIG. 6 is a top plan view of the bottle sealing apparatus of FIG. 3.

As shown in FIGS. 5 and 6, a single drive motor 80 is desirably provided for driving the drive sprocket 42, first reciprocator 56, second reciprocator 72, and timing screw 76 in synchronism for forming the seals 22 on the bottles 66. The drive motor 80 is typically a variable speed motor, and rotates a main drive shaft 82. The drive shaft 82 is coupled with a gearbox 84 which is in turn coupled to a sprocket drive belt 86 that drives the drive sprocket 42 and the drive chain 36 in rotation. As best seen in FIG. 6, a preferred embodiment employs a pair of horizontally spaced drive chains 36 that move in unison and provide a more secured connection with the die truck assemblies 50 by coupling to two sides of the assemblies 50. The main drive shaft 82 also drives the first reciprocator 56 through a first reciprocator drive belt 90 rotating a first cam, and drives the second reciprocator 72 through a second reciprocator drive belt 94 rotating a second cam. The main drive shaft 82 further drives the timing screw 76 through a timing screw drive belt 98.

The drive belts 86, 90, 94, 98 and gearbox 84 preferably provide the proper rotational reductions and gear ratios so as to synchronize the movement and speed of the drive sprocket 42, first reciprocator 56, second reciprocator 72, and timing screw 76. This ensures that the first reciprocator 56 moves the first applicator 54 at the same speed as each die truck assembly 50 over the first deposition time period, that the timing screw 76 feeds the bottles 66 with the same spacings to match those between the die truck assemblies 50, and that the second reciprocator 72 moves the second applicator 70 at the same speed as each bottle 66 over the second deposition time period. In this way, the process rate of the entire apparatus 30 can be easily changed by simply adjusting the speed of the single drive motor 80 while preserving the synchronism of the various components.

In the preferred embodiment, the apparatus 30 is easily adjustable to process bottles 66 of different heights. As shown in FIGS. 5 and 6, the drive chain 36, drive sprocket 42, first applicator 54, first reciprocator 56, second applicator 70, second reciprocator 72, and the drive motor 80 are attached to the upper support frame 32. The timing screw 76 and bottle conveyor 64 are attached to the lower support frame 34. The vertical position of the upper support frame 32 is adjustable relative to the lower support frame 34 via a pair of jacking screws 102. The height adjustment of the upper frame 32 varies the vertical spacing between the die truck assemblies 50 and the bottle conveyor 64, thereby adapting the apparatus 30 to processing bottles 66 with different heights.

Figure 7:
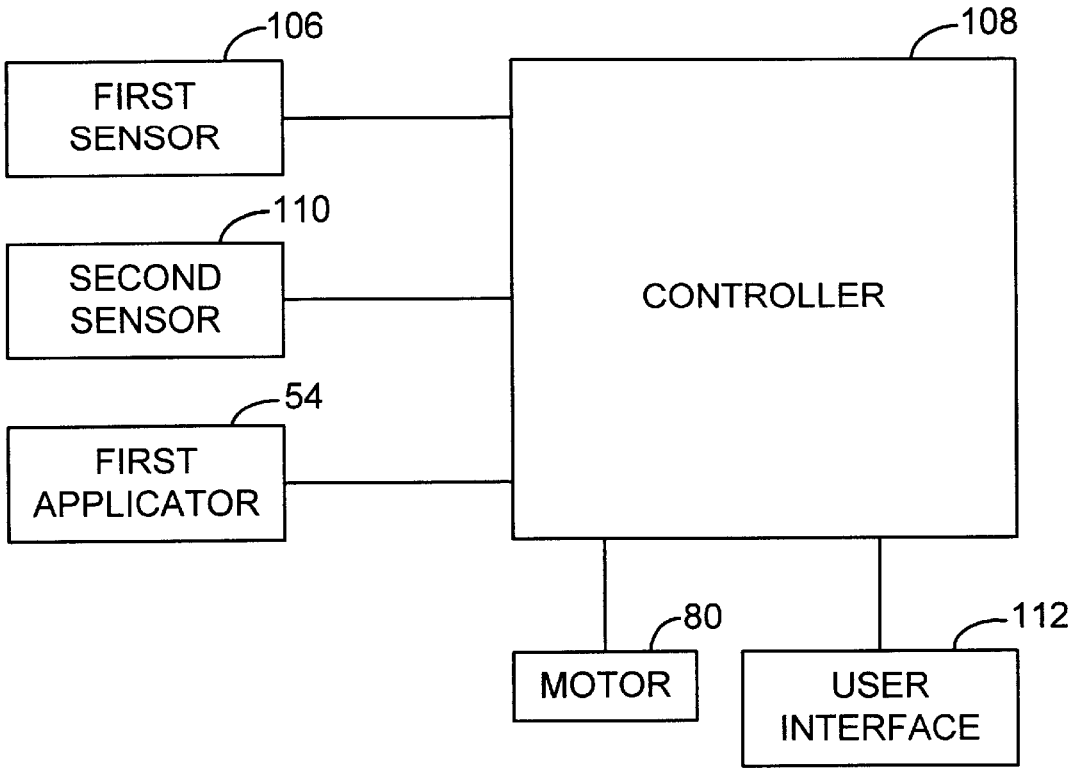
FIG. 7 is a block diagram illustrating the control of operation of the apparatus 30.

Referring to FIGS. 3 and 5, a first sensor 106 is positioned adjacent the end of the bottle conveyor 64 for sensing presence or absence of an embossed seal portion 16 in the die cavity of each die truck assembly 50 that passes therethrough. The first sensor 106 is typically a photoelectric sensor. A bottle sensor 107 may be used to detect the presence of a bottle passing therethrough. If a bottle is passing through but the sensor 106 detects a seal portion 16 remaining in the die cavity, the first sensor 106 generates a reject signal indicating failure of releasing the embossed seal portion 16 from that die truck assembly 50 into the corresponding bottle 66 to form the finished seal 22. This ensures that bottles 66 that are not properly sealed with embossed seals 22 are identified and removed. In a specific embodiment, the first sensor 106 is coupled with a controller 108 which receives the reject signal and directs operation to remove the rejected bottle, as illustrated in FIG. 7. The controller 108 is typically an electronic controller including a microprocessor. A second sensor 110 may also be provided to detect the presence or absence of an embossed seal portion 16 in the die cavity of each die truck assembly 50 just prior to injection of the molten seal material by the first applicator 54 (FIGS. 3 and 5). The second sensor 110 generates a signal to the first applicator 54 through the controller 108 to prevent injection of the molten seal material into the die cavity of the assembly 50 when an embossed seal portion 16 is still disposed in the die cavity (FIG. 7). In an alternative embodiment, the controller 108 records the reject signal from the first sensor 106 and tracks the position of the die truck assembly 50 with the embossed seal portion 16 remaining therein, and directs the first applicator 54 to refrain from injecting material into that assembly 50 when it passes therethrough. In this way, the second sensor 110 can be eliminated.

As shown in FIG. 7, the controller 108 typically is coupled with the motor 80 to control operation of the motor 80, including its speed. To interface with the controller 108, a user interface 112 is provided. Examples of a user interface 112 include a keyboard, a pointing device, and a keypad.

Die Truck Assembly

Figure 8:
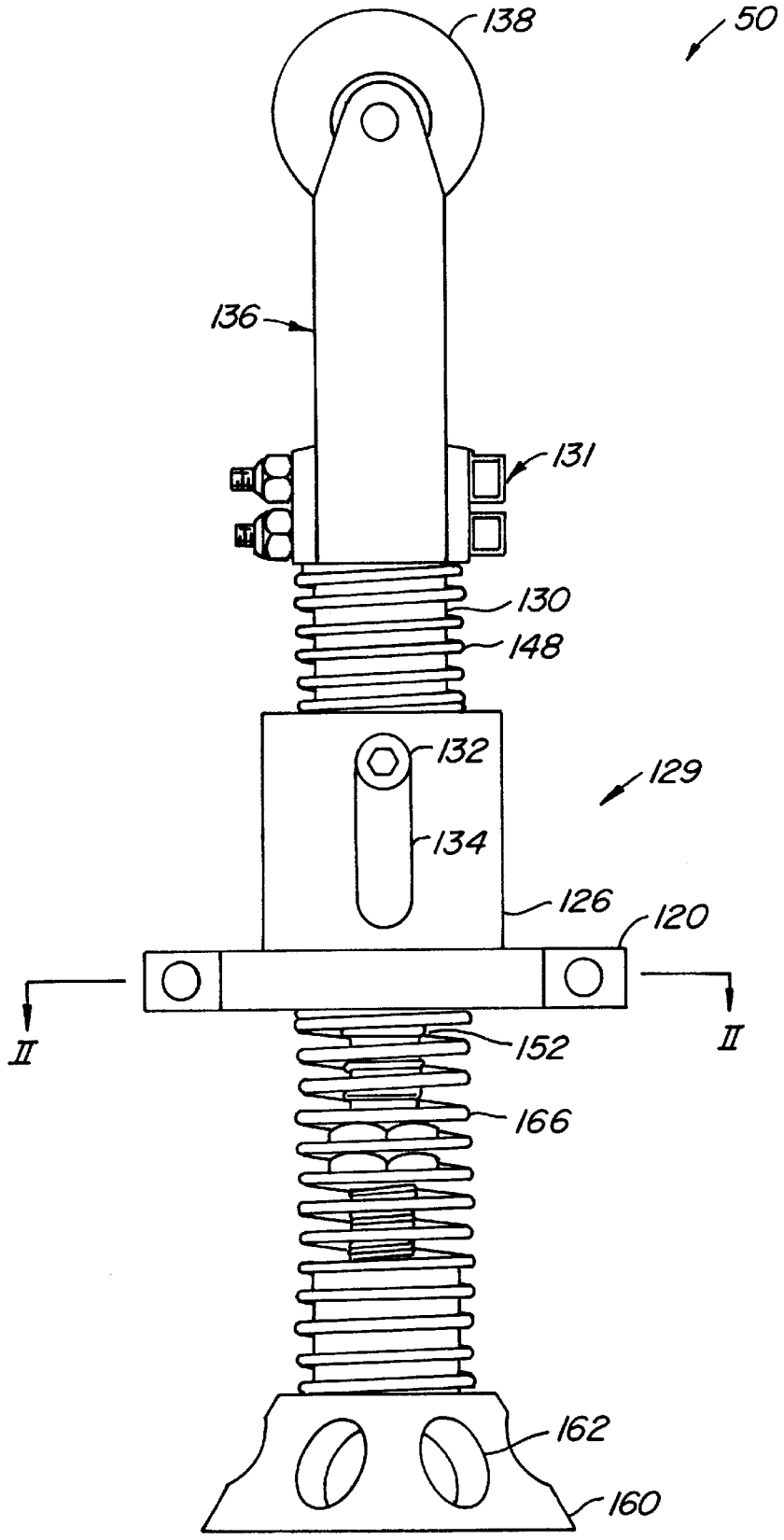
FIG. 8 is a front elevational view of a die truck assembly in accordance with an embodiment of the present invention.
Figure 9:
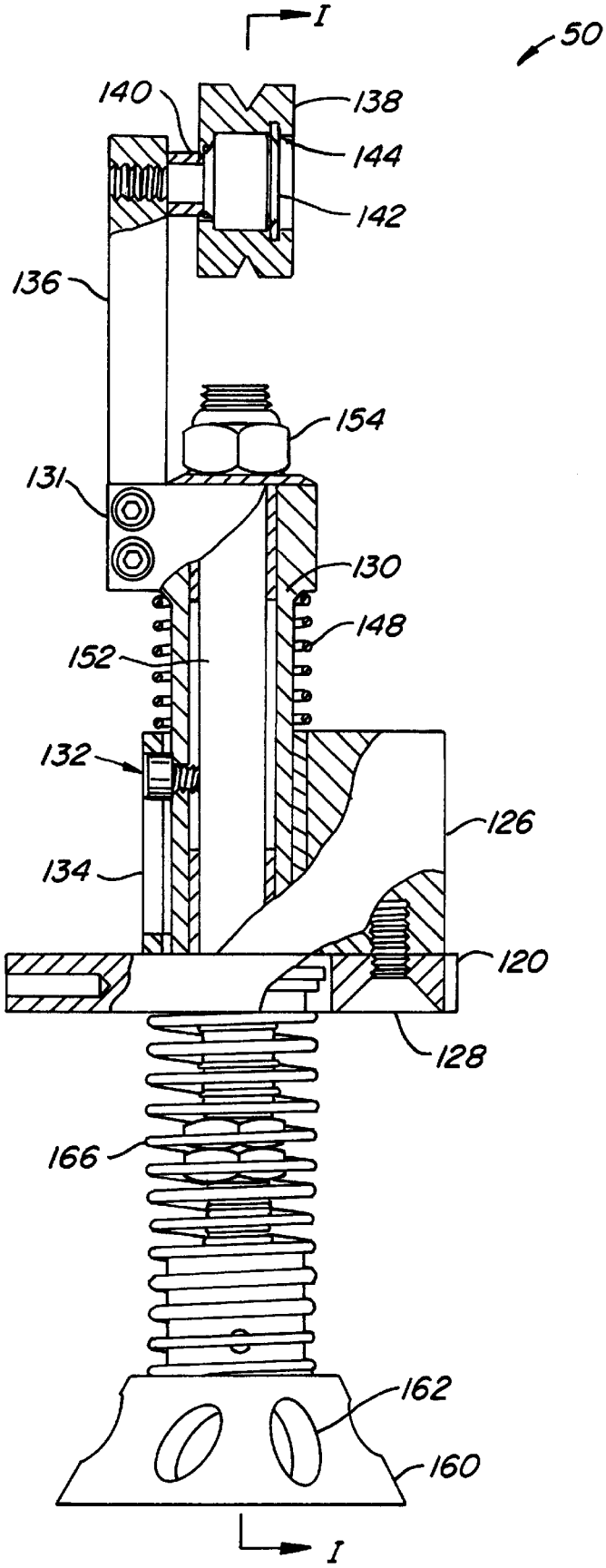
FIG. 9 is a side elevational view of the die truck assembly of FIG. 8 with partial cross-sections.
Figure 10:
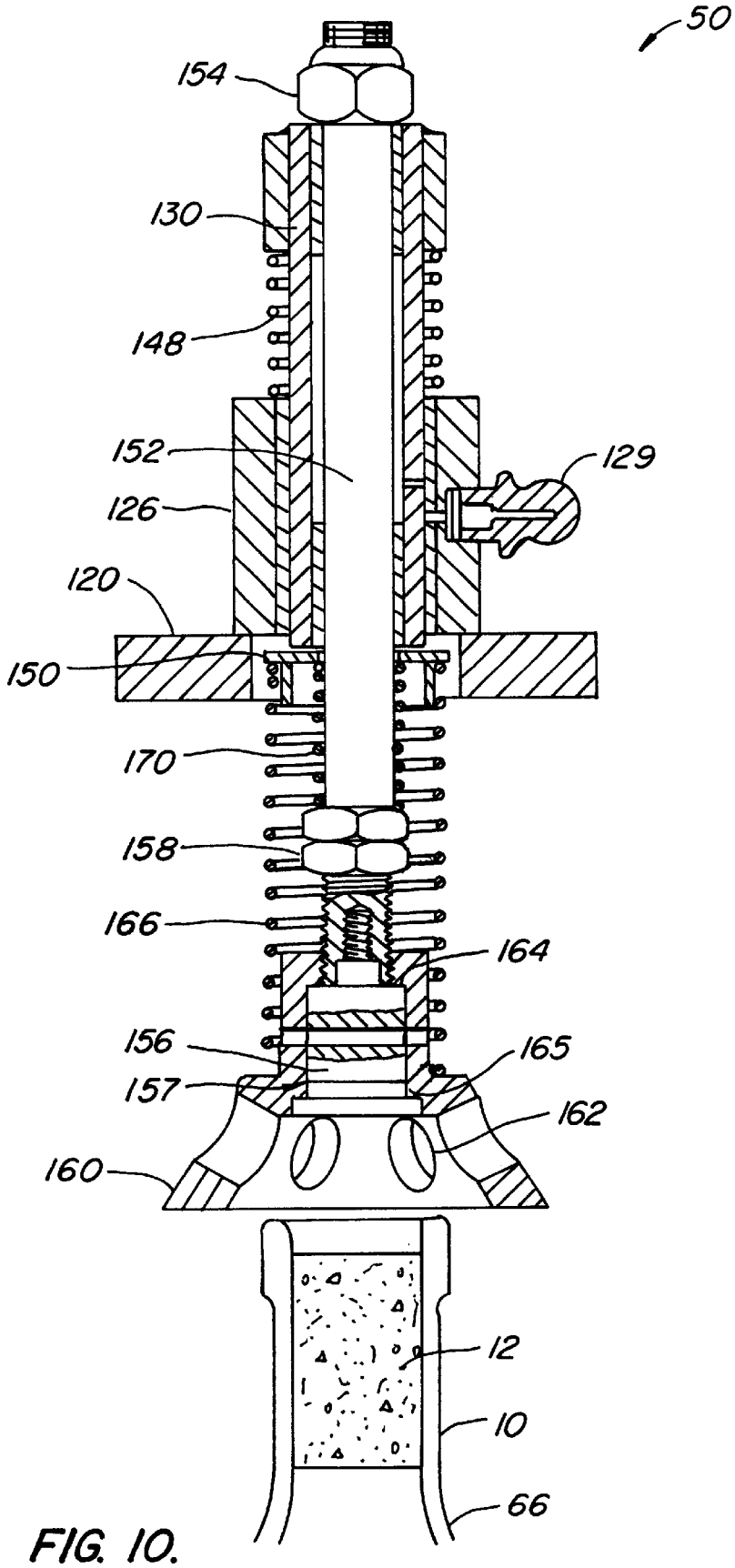
FIG. 10 is a cross-sectional view of the die truck assembly of FIG. 8 along line I—I.
Figure 11:
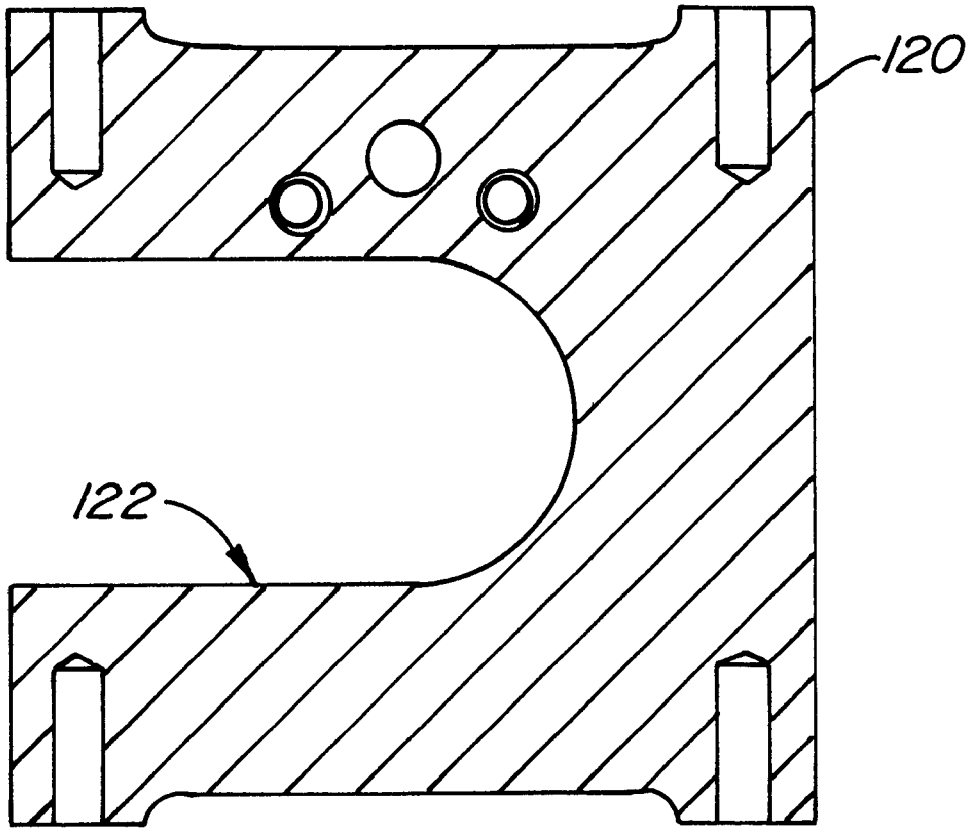
FIG. 11 is a cross-sectional view of the die truck assembly of FIG. 8 along line II—II.

FIGS. 8–14 show details of a die truck assembly 50. The assembly 50 includes a carrier plate 120 which is connected to the drive chain 36 (FIG. 3). As best seen in FIG. 11, the carrier plate 120 includes a U-shaped recess 122 and a pair of holes. An actuator guide block 126 is generally fixed to the carrier plate 12 by fastener 128 and includes a grease fitting 129 (FIG. 9). An actuator guide tube 130 is disposed through the opening of the guide block 126 and the recess 122 of the carrier plate 120. A guide pin 132 is connected to the guide tube 130 and constrained to move generally vertically along a guide slot 134 in the guide block 126, thereby restricting the movement of the guide tube 130 in the vertical direction relative to the guide block 126 (FIGS. 8 and 9).

As best seen in FIGS. 8 and 9, a wheel bracket 136 is coupled to the top of the guide tube 130 by fasteners 131 at one end and to an actuator wheel 138 at the other end through a spacer 140. An inner wheel support 142 is coupled in the interior of the wheel 138 by a retainer clip 144. The wheel 138 is coupled with the wheel track 68 and rolls on the wheel track 68 as the assembly 50 is driven by the drive chain 38 (FIG. 3). As shown in FIGS. 8–10, an actuator spring 148 is coupled between the guide tube 130 and the guide block 126, and is compressible from the rest position shown to allow the guide tube 130 to move downward relative to the guide block 126.

A spring seat 150 is attached to the guide tube 130, as best seen in FIG. 10. A die stem 152 is disposed inside the guide tube 130 and is slidable relative thereto generally in the vertical direction. Attached to the upper end of the die stem 152 is a stop 154 which defines the limit of downward movement of the die stem 152 relative to the guide tube 130. At the lower end of the die stem 152 is a die support portion 156 for supporting a die 157 having a die surface with a die image for forming the embossed surface 20 on the seal 22 (FIG. 2). The die 157 is desirably made using a minting process that produces a high quality die with consistency and long life at a relatively low cost. A blocking member 158, shown in FIG. 10 as including a pair of jam nuts, is attached to the die stem 152 and spaced below the spring seat 150 by a distance. The guide tube 130 and die stem 152 form a die holder for supporting the die 157. The movements of the guide tube 130 and die stem 152 facilitate formation of the embossed seal portion 16 in the die truck assembly 50 and the release of the embossed seal portion into the cavity of the bottle 66, as explained in more detail below.

A centering member 160 is coupled with the die stem 152 near the die support portion 156 and is slidable generally vertically relative to the die stem 152. The centering member 160 has a generally conical shape enlarging in a direction away from the spring seat 150. As seen in FIG. 10, the conical inner surface of the centering member 160 conveniently centers the cavity above the cork 12 in the neck 10 of the bottle 66 with respect to the die 157 of the die truck assembly 50 when the die stem 152 is moved downward to engage with the bottle 66. The centering member 160 desirably includes a plurality of openings 162 to facilitate cooling of the bottle neck 10 to hasten the solidification of the molten seal material 14 therein to form the seal 22 (FIGS. 1*a*–2). The centering member 160 includes a retaining portion 164 which limits the downward movement of the centering member 160 relative to the die stem 152 and prevents it from separating from the die stem 152. An inner wall 165 of the centering member 160 is disposed around the die 157 which is recessed from the edge of the inner wall 165 to form the die cavity for making the embossed seal portion 16 (FIG. 1*a*).

An engagement spring 166 is coupled between the spring seat 150 on the guide tube 130 and the centering member 160. The compression of the engagement spring 166 from its rest position shown in FIG. 10 allows the centering member 160 to move upward relative to the guide tube 130 and die stem 152. This upward movement causes the die 157 to protrude from the edge of the inner wall 165 of the centering member 160 and push the embossed seal portion 16 out of the die cavity to release it from the die truck assembly 50. The upward movement also provides tolerance in movement of the centering member 160 to adapt the assembly 50 to bottles 66 having slightly varying heights.

A die stem spring 170 is coupled between the spring seat 150 on the guide tube 130 and the blocking member 158 on the die stem 152. The compression of the die stem spring 170 from its rest position shown in FIG. 10 permits upward movement of the die stem 152 relative to the guide tube 130. This upward movement allows the die stem 152 to adapt to corks 12 of slightly varying depths from the openings of the necks 10 of the bottles 66 so as to exert a generally consistent pressure on the embossed seal portion 16 and the molten seal material 14 to form the finished seal 22 regardless of cork depth.

Note that the actuator spring 148, engagement spring 166, and die stem spring 170 may be relaxed but are typically in slight compression in the rest position shown in FIGS. 8–10 to bias the components of the die truck assembly 50 in specific positions relative to each other.

Figure 12:
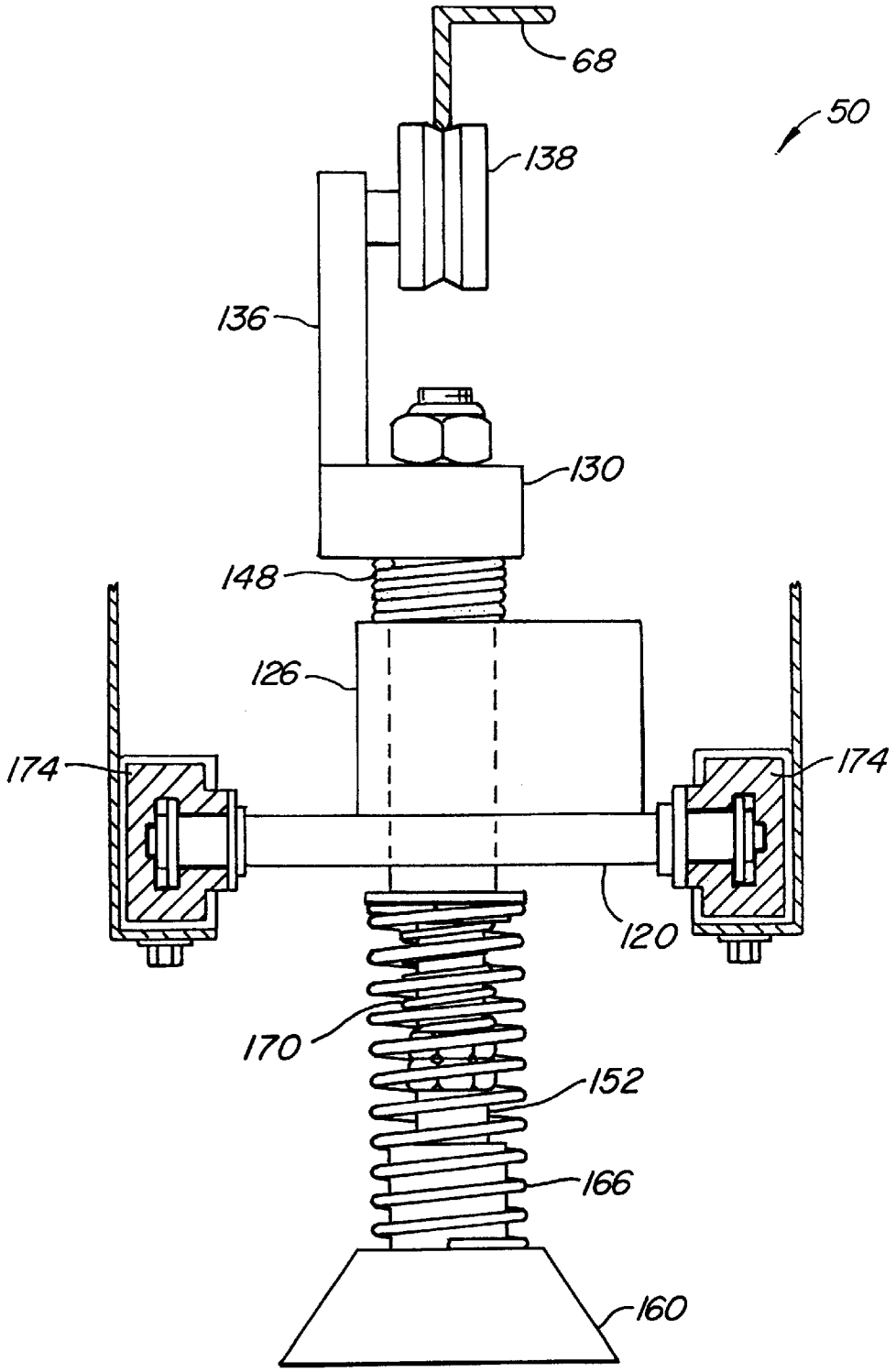
FIG. 12 is a side elevational view of the die truck assembly of FIG. 8 illustrating the compression of the actuator spring.
Figure 13:
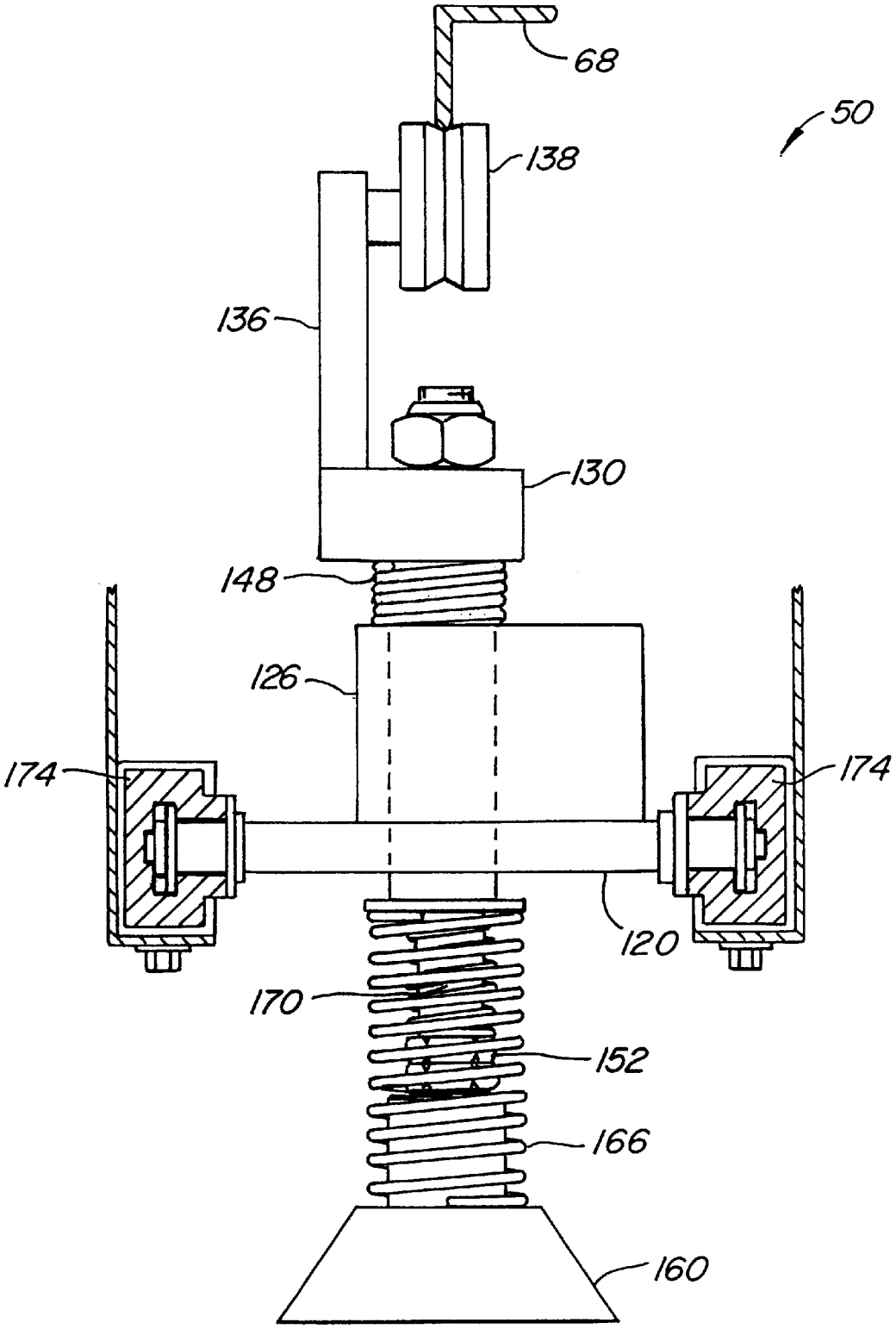
FIG. 13 is a side elevational view of the die truck assembly of FIG. 8 illustrating the compression of the engagement spring.
Figure 14:
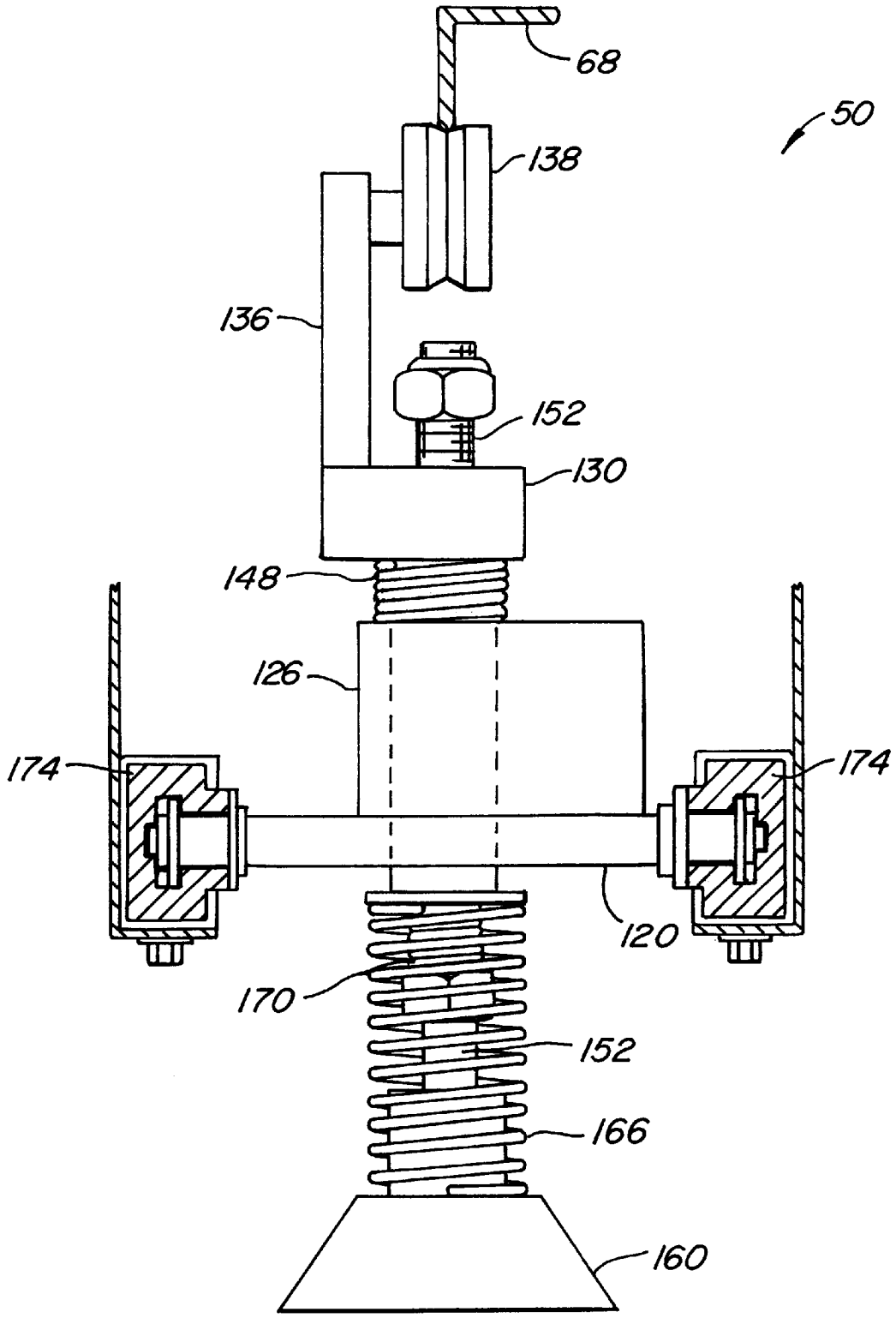
FIG. 14 is a side elevational view of the die truck assembly of FIG. 8 illustrating the compression of the die stem spring.

The triple telescoping action of the die truck assembly 50 is illustrated in FIGS. 12–14. The carrier plate 120 is attached to a pair of guide tracks 174 which are connected with the drive chain 36 to travel around the path of the drive chain 36 (FIG. 3). In a preferred embodiment, the apparatus 30 includes a pair of parallel drive chains 36 supporting the two sides of the carrier plate 120 through the pair of guide tracks 174 and moving in unison to transport the assemblies 50. For purposes of the following discussion, the carrier plate 120 serves as a reference for vertical movements of the various components of the assembly 50. In FIG. 12, the offset portion of the wheel track 68 along the lower path portion 40 of the drive chain 36 pushes the actuator wheel 138, bracket 136, and guide tube 130 downward to compress the actuator spring 148 against the guide block 126. The downward movement of these components forming the actuation portion of the assembly 50 causes the die stem 152 and the centering member 160 to move downward with the guide tube 130.

When the centering member 160 meets the neck 10 of the bottle 66, it is pushed upward by the neck 10 and toward the carrier plate 120 to compress the engagement spring 166, which maintains the engagement between the centering member 160 and the bottle neck 10, as shown in FIG. 13. The upward movement of the centering member 160 relative to the die stem 152 causes the die 157 to protrude from the edge of the inner wall 165 of the centering member 160 and push the embossed seal portion 16 out of the die cavity to release it into the molten seal material in the cavity of the bottle 66.

In FIG. 14, the die stem spring 170 is compressed when the die stem 152 is pushed upward with the embossed seal portion 16 by the cork 12 and the molten seal material 14 in the bottle neck 10 (FIG. 1*a*). The upward movement allows the die stem 152 to adapt to corks 12 of slightly varying depths from the openings of the necks 10 so as to exert a generally consistent pressure to form the finished seal 22 regardless of cork depth.

After the die truck assembly 50 is disengaged from the bottle 66, the biasing forces of the actuator spring 148, engagement spring 166, and die stem spring 170 return the components of the assembly 50 to the rest position shown in FIGS. 8–10. In an alternative embodiment, the actuator spring 148 is eliminated so that the die truck assembly 50 provides a double telescoping action. Instead of pushing the actuator wheel 138, bracket 136, and guide tube 130 downward to engage the assembly 50 with the neck 10 of the bottle 66, the bottle 66 is moved upward to meet the assembly 50. In such a system, the third telescoping action of moving the guide tube 130 downward to engage with the bottle neck is not needed.

Bottle Sealing Procedure

The bottle sealing process employing the apparatus 30 of FIGS. 3–7 with the die truck assembly 50 of FIGS. 8–14 is described as follows. Referring to FIGS. 3–7, the drive motor 80 is turned on to drive the drive chain 36 to move the die truck assemblies 50. The first applicator 54 is activated to introduce a first amount of the molten seal material into the die cavity of each die truck assembly 50 that passes therethrough over a first deposition time period controlled by the first reciprocator 56. The die surface of the die 157 forming the bottom of the die cavity is typically at about ambient temperature. The molten seal material in the die cavities are cooled by the cooling device 60 and/or the cooling nozzles 61 to form the embossed seal portions 16 as the assemblies 50 pass therethrough along the upper path portion 38. The assemblies 50 are transported by the drive chain 36 to the lower path portion 40.

Before the assemblies 50 reach the lower path portion 40, bottles 66 are fed through the timing screw 76 to the bottle conveyor 64 which are synchronized in movement with the assemblies 50 to align the necks 10 of the bottles 66 with the assemblies 50. The second applicator 70 is activated to introduce a second amount of the molten seal material into the cavity of each bottle 66 before it is transferred to the bottle conveyor 64. When the bottle 66 is aligned with the die truck assembly 50, the offset portion of the wheel track 68 on the upper support frame 32 pushes the components of the assembly 50 except the carrier plate 120 and guide block 126 downward to engage the assembly 50 with the bottle neck 10. At this time, the embossed seal portion 16 in the die cavity of the assembly 50 is sufficiently cooled to be at least substantially solidified, while the seal material in the bottle cavity remains at least substantially molten. The molten seal material in the cavity of the bottles 66 may be cooled using the cooling nozzles 62. The seal material is still hot enough to partially melt the embossed seal portion 16 to form a single seal, but is sufficiently cooled to prevent melting of the embossed surface 20 of the embossed seal portion 16.

The triple telescoping action provided by the actuator spring 148, engagement spring 166, and die stem spring 170 of the assembly 50 maintains the engagement between the centering member 160 and the bottle neck 10 along the lower path portion 40 of travel of the assembly 50, releases the embossed seal portion 16 into the molten seal material in the bottle cavity, and exerts a generally consistent pressure on the embossed seal portion 16 and molten seal material to form the finished seal 22, as illustrated in FIGS. 12–14. The embossed seal portion 16 is sufficiently cooled so that the embossed surface 20 thereon is preserved upon separation of the die surface from the embossed surface 20 and the heat of the molten seal material in the bottle cavity does not cause melting of the embossed surface 20.

As the embossed seal portion 16 makes the transition of leaving the die cavity of the die truck assembly 50 and meeting the molten seal material in the bottle cavity, it adheres to the die 157 via a small amount of surface tension. The die 157 is typically made of a polished, plated metal. Once the embossed seal portion 16 encounters a force that opposes the surface tension with the die 157, the seal portion 16 will separate from the die 157 and join with the molten seal material in the bottle cavity. Such a force may be a press-fit of the diameter or width of the seal portion 16 into the bottle neck 10, or the sticking force of the molten seal material in contact with the seal portion 16.

During the engagement of the die truck assemblies 50 with the bottle necks 10, the offset portion of the wheel track 68 keeps the actuation portion of each assembly 50 in the downward position, thereby maintaining continued contact of the die 157 with the embossed seal portion 16 during the cooling of the molten seal material and formation of the finished seal 22 in the bottle neck 10. This minimizes disturbance of the embossed image on the seal to avoid "blocking" of the die image on the die 157 with seal residue of the seal by premature movement of the die surface and the embossed surface of the seal.

At the end of the lower path portion 40, the wheel track 68 exits the offset portion and allows the springs 148, 166, 170 to raise the actuation portions of the die truck assemblies 50 in a generally vertical direction to disengage them from the bottles 66, as shown in FIGS. 3 and 5. The first sensor 106 senses presence or absence of an embossed seal portion 16 in the die cavity of each die truck assembly 50. If a seal portion 16 is detected, the first sensor 106 generates a reject signal indicating failure of releasing the embossed seal portion 16 from that die truck assembly 50 into the corresponding bottle 66 to form the finished seal 22. If the second sensor 110 senses the presence of an embossed seal portion 16 in the die cavity of a die truck assembly 50, it generates a signal to the first applicator 54 through the controller 108 to prevent injection of the molten seal material into the die cavity of that assembly 50.

In one embodiment, the apparatus 30 includes 54 die truck assemblies 50 driven by the drive chain 36 at a rate for processing 180–250 bottles per minute. This process rate is made possible by the two-stage procedure that forms the upper seal portions 16 and allows them to cool before releasing them into pools of molten seal material in the bottle neck cavities to form complete seals.

The methods and apparatus of the present invention permit the sealing of corked bottles at ambient temperature. The formation of the upper embossed seal portion 16 in the die cavity of a die truck assembly 50 before joining it with the molten seal material 14 in the bottle neck 10 allows the embossed image to form on the embossed seal portion 16 with minimal disturbance. Partial melting of the embossed seal portion 16 by the molten seal material 14 in the bottle neck 10 avoids damage to the embossed image. Providing a sufficient period of cooling of the embossed seal portion 16 to at least a semi-solid state prior to separation from the die 157 ensures adequate skin-over to preserve the image. Maintaining continued contact of the die 157 with the embossed seal portion 16 during the partial melting of the embossed seal portion 16 and cooling of the molten seal material 14 to form the finished seal 22 minimizes disturbance of the embossed image on the seal to avoid "blocking" of the image. Moreover, it is possible to form a seal with a "squeeze-up" finish having a hand-made look by squeezing up the molten seal material around the edge. The amount of the squeeze-up can be controlled by varying the temperature and/or volume of the molten seal material 14 applied in the cavity of the bottle neck 10 as well as the size (diameter and thickness) of the upper seal portion 16 formed in the die cavity of the die truck assembly 50.

The above-described arrangements of apparatus and methods are merely illustrative of applications of the principles of this invention and many other embodiments and modifications may be made without departing from the spirit and scope of the invention as defined in the claims. For instance, although mechanical mechanisms are described for synchronizing the movements of the drive sprocket 42, drive chain 36, first reciprocator 56, second reciprocator 72, and timing screw 76, electronic systems can be used instead to synchronize movements of the components. Moreover, although the above discussion focuses on forming embossed seals in corked bottles, the present invention is not so limited but can be used for making seals in other cavities. The scope of the invention should, therefore, be determined not with reference to the above description, but instead should be determined with reference to the appended claims along with their full scope of equivalents.

What is claimed is:

1. A method of forming an embossed seal in a cavity in the neck of a corked bottle over a cork using a die having a die surface with a die image, the method comprising:

bringing the die surface in contact with a first molten seal material and cooling the molten seal material to form a cooled embossed seal portion with an embossed surface on one side and an interface surface on another side;

introducing a second molten seal material into the cavity of the neck of the corked bottle over the cork; and bringing the interface surface of the cooled embossed seal portion into contact with the second molten seal material in the cavity, before the second molten seal material hardens, to partially melt the embossed seal portion with the second molten seal material and join the partially melted embossed seal portion with the second molten seal material in the cavity to form a seal over the cork, the seal having the embossed surface.

2. The method of claim 1 wherein die surface is brought in contact with the first molten seal material by introducing the first molten seal material into a die cavity having the die surface forming a lower portion of the die cavity.

3. The method of claim 1 wherein the die surface is brought in contact with the first molten seal material when the die surface is at about ambient temperature.

4. The method of claim 1 wherein the amount of the first molten seal material comprises about 50% to about 90% of the sum of the amount of the first molten seal material and the amount of the second molten seal material.

5. The method of claim 4 wherein the amount of the first molten seal material comprises about 80% of the sum of the amount of the first molten seal material and the amount of the second molten seal material.

6. The method of claim 1 wherein the molten seal material comprises a molten thermoplastic material.

7. The method of claim 1 wherein the first molten seal material and the second molten seal material are the same.

8. The method of claim 1 wherein the interface surface of the embossed seal portion is opposite from the embossed surface.

9. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork; and bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface, wherein the first molten seal material is cooled by a gas flow.

10. The method of claim 9 wherein liquid nitrogen is introduced into the gas flow for cooling the first molten seal material.

11. The method of claim 9 wherein the gas flow is controlled to distribute the first molten material to form a desired interface surface profile.

12. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork; and bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface, wherein the cooled embossed seal portion is at least substantially solidified before the interface surface is brought into contact with the molten seal material in the cavity.

13. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork;

bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface; and separating the die surface from the cooled embossed seal portion after the interface surface of the cooled embossed seal portion is brought into contact with the molten seal material in the cavity.

14. The method of claim 13 further comprising maintaining contact between the die surface and the embossed seal portion until the molten seal material in the cavity is at least partially solidified.

15. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork; and bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface, wherein the die surface is separated from the cooled embossed seal portion after sufficient solidification of the cooled embossed seal portion near the embossed surface such that the embossed surface is preserved upon separation of the die surface from the embossed surface.

16. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork;

bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface; and directing a gas flow toward the first molten material to distribute the first molten material to form a desired interface surface profile.

17. The method of claim 16 wherein the first molten material is distributed to form a generally planar interface surface profile.

18. The method of claim 16 wherein the first molten material is distributed to form a generally concave interface surface profile.

19. A method of forming an embossed seal in a cavity in the neck of a corked bottle over a cork using a die having a die surface with a die image, the method comprising:

bringing the die surface in contact with a first molten seal material and cooling the molten seal material to form an embossed seal portion with an embossed surface on one side and an interface surface on another side;

introducing a second molten seal material into the cavity of the neck of the corked bottle over the cork;

bringing the interface surface of the cooled embossed seal portion into contact with the molten seal material in the cavity to partially melt the embossed seal portion and join the embossed seal portion with the second molten seal material in the cavity to form a seal over the cork, the seal having the embossed surface; and directing a gas flow toward the second molten material to distribute the second molten material to form a desired surface profile.

20. The method of claim 19 wherein the first molten material is distributed to form a generally planar surface profile.

21. The method of claim 19 wherein the first molten material is distributed to form a generally concave surface profile.

* * * * *